US007594858B2

(12) United States Patent
Hauk

(10) Patent No.: US 7,594,858 B2
(45) Date of Patent: Sep. 29, 2009

(54) GOLF SWING PRACTICE SYSTEM

(75) Inventor: Thomas D. Hauk, Palm Desert, CA (US)

(73) Assignee: Hawknest Engineering LLC, Palm Desert, CA (US)

( * ) Notice: Subject to any disclaimer, the term of this patent is extended or adjusted under 35 U.S.C. 154(b) by 378 days.

(21) Appl. No.: 11/428,807

(22) Filed: Jul. 5, 2006

(65) Prior Publication Data

US 2007/0155521 A1 Jul. 5, 2007

Related U.S. Application Data

(60) Provisional application No. 60/717,927, filed on Sep. 16, 2005.

(51) Int. Cl.
*A63B 69/36* (2006.01)

(52) U.S. Cl. ..... 473/146

(58) Field of Classification Search ..... 473/146, 473/257, 219

See application file for complete search history.

(56) References Cited

U.S. PATENT DOCUMENTS

| | | | | |
|---|---|---|---|---|
| 2,124,123 | A | 7/1938 | Rosengarten | |
| 2,490,409 | A | 12/1949 | Brown | |
| 2,641,932 | A * | 6/1953 | Van Kinkle | 473/146 |
| 2,641,933 | A * | 6/1953 | Van Kinkle | 473/146 |
| 2,660,436 | A * | 11/1953 | Grossman | 473/237 |
| 2,777,824 | A | 1/1957 | Leeds | |
| 3,055,297 | A | 9/1962 | Leeds | |
| 3,107,919 | A | 10/1963 | MacKenzie | |
| 3,292,436 | A | 12/1966 | Bahnsen | |
| 3,754,764 | A * | 8/1973 | Manheck | 473/237 |
| 3,790,176 | A | 2/1974 | Rietz | |
| 4,949,973 | A | 8/1990 | Williamson | |
| 5,082,284 | A | 1/1992 | Reed | |
| 5,142,309 | A | 8/1992 | Lee | |
| 5,230,297 | A | 7/1993 | Lakatos | |
| 5,451,059 | A | 9/1995 | Weis | |
| 5,779,556 | A * | 7/1998 | Cervantes et al. | 473/237 |
| 5,830,077 | A * | 11/1998 | Yavitz | 473/226 |
| 5,910,053 | A | 6/1999 | Scalise | |
| 6,099,412 | A | 8/2000 | Weibye | |
| 6,106,406 | A | 8/2000 | Jousan | |
| 6,364,784 | B1 | 4/2002 | Fuhre | |
| 6,659,775 | B1 | 12/2003 | Moy | |
| 7,086,956 | B2 * | 8/2006 | Matthews | 473/226 |
| 7,134,967 | B2 * | 11/2006 | Lester | 473/237 |
| 2001/0009870 | A1 | 7/2001 | Hammerquist | |
| 2007/0155521 | A1 * | 7/2007 | Hauk | 473/146 |

* cited by examiner

*Primary Examiner*—Raleigh W. Chiu
(74) *Attorney, Agent, or Firm*—Julio M. Loza; Loza & Loza, LLP

(57) ABSTRACT

A golf swing practice apparatus including a golf ball simulation target and anchor for securing the target to a support surface. The anchor may be a ground stake when the surface is the ground and, alternatively, a mat anchor when the surface is a golf training mat. A connector arm horizontally offsets the anchor out of the way from the target, and can be adjustably positioned relative to the target to raise or lower the position of the target above the support surface as desired. A marker is supported by the target for leaving a mark on the golf club head during a practice swing. The location of the mark relative to the "sweet spot" on the golf club head can be used to adjust the golf swing. The mark can be two marks whose relative sizes indicate whether the target was hit with an open or close face impact.

39 Claims, 14 Drawing Sheets

Straight and square impact

Closed club (Hook) impact

Open club (Slice) impact

Straight and square club head
Lite Impact

Straight and square club head
Heavy Impact

Closed club head(hard hook)
Lite Impact
Center of Sweet Spot

Closed club head (hard hook)
Heavy impact
Outside edge of Sweet Spot

Open club head (hard slice)
Heavy Impact
Inside edge of Sweet Spot

Open club head (hard slice)
Lite Impact
Center of Sweet Spot

Topped the Ball
Outside Sweet Spot

Lie angle
Address too far
from ball or club too long

GOLF SWING PRACTICE SYSTEM

CLAIM OF PRIORITY UNDER 35 U.S.C. §119

The present Application for patent claims priority to Provisional Application No. 60/717,927 entitled "Golf Swing Training System", by Thomas D. Hauk, filed Sep. 16, 2005, and expressly incorporated by reference herein.

BACKGROUND

1. Field

Various embodiments of the invention pertain to golf swing practice/training devices and, in particular, to a device providing a realistic practice target that, when struck, provides an indication of the position, direction, orientation, and/or strength of the golf swing.

2. Background

When playing golf, it is important to swing the golf club to provide maximum control over the direction and distance that the impacted golf ball travels. A need exists for golf practice apparatuses which provide useful, quick and accurate information to the golfer as to the quality and characteristics of a practice swing. These apparatuses should be designed and constructed to not only be sturdy to survive numerous impacts of the golf club head, but also to be easy to use.

Some prior art golf swing practice devices fail to provide a realistic swing target and/or accurate feedback of direction, orientation, and/or strength of the golf swing.

U.S. Pat. No. 1,363,446, by E. J. Vogel, describes a device including a substitute golf ball coupled to a mat by a substantially vertical tongue that flexes when the substitute golf ball is struck by a golf club. This device fails to provide feedback to a player about the direction, orientation, and/or strength of the golf swing.

U.S. Pat. No. 1,733,767, by L. E. Yaggi, describes a golf swing practice device including a supporting stake and a golf ball target coupled to the supporting stake by a ball-and-socket mechanism. When struck by a golf club, the golf ball target bends at the ball-and-socket point to indicate the direction of swing. The player must determine the rotation of the bent practice golf ball to ascertain whether the practice golf ball was struck straight or at an angle. This device fails to ascertain whether the target golf ball was struck high or low, the relative strength of the swing, and whether the practice golf ball was struck by the sweet spot of the golf club. Additionally, another disadvantage of this device is that the player must manually reset the practice golf ball every time.

U.S. Pat. No. 2,490,409, by P. H. Brown, merely describes a target golf ball that can be secured to a practice surface and flexes when struck by golf club. This target golf ball is not a realistic golf ball target and fails to provide any indication of the position, direction, orientation, and/or strength of the golf swing.

U.S. Pat. No. 5,451,059, by Weis, discloses a golf ball practice target having a substantially vertical support that, when struck, causes the golf ball practice target to return to its rest position. A hole at the center of the golf ball practice target is used to provide an audible indicator of a proper swing. However, as with other prior art, this golf ball practice target fails to provide any indication of the position, direction, orientation, and/or strength of the golf swing or whether the golf club struck the golf ball practice target on the club head's sweet spot.

U.S. Pat. No. 6,569,026, by Weis, discloses a golf swing practice apparatus having a golf ball target mounted on a vertical support that flexes when the golf ball target is struck by a golf club. The golf ball target includes a pointer that aligns itself with the direction of the golf club swing, thereby providing an indication of the swing. However, this device is inaccurate and fails to provide any indication of the position and/or strength of the golf swing or whether the golf club struck the golf ball practice target on the club head's sweet spot.

U.S. Pat. No. 6,659,775, by Moy, discloses a golf swing practice apparatus having a ball support having marking tabs along the upper edge of the support. In theory, when a golf ball mounted on the ball support is struck by a golf club, the marking tabs leave a mark on the golf club face. However, this device does not work unless the ball support is struck and, because the markers are offset from the golf ball surface, also fails to provide an accurate indication of how the ball is struck.

SUMMARY

Disclosed herein is a golf swing practice apparatus including a golf ball simulation target coupled to an anchor for anchoring the target to a support surface. This flexible target may include a round golf ball simulation target unit with a connector arm. The end of the arm opposite to the target unit is secured to the anchor such that the center of the target unit is offset, out of the way of the anchor, a horizontal distance.

One example of the invention provides a golf swing practice system with visual indications of a realistic golf club swinging direction (e.g., straight, slicing, hooking, undercutting, topping, etc.). The golf swing practice system is a compact apparatus that can be deployed indoors and/or outdoors and provides a user the sensation of striking a golf ball with a club. Upon striking a simulated golf ball target, the golf club face is marked with one or more indicators of the position of the golf club face relative to the golf simulated ball target. These one or more indicators can then be used to determine the golf club swinging characteristics, including quality, speed, geometric, and/or direction.

Another aspect of the invention provides different ways of marking a golf club face to convey the type of contact between a golf ball and a golf club face.

Another feature of the invention provides various types of cartridges that can be used to deposit markings on a golf club face as indicators of the quality and characteristics of a golf practice swing.

Yet another feature of the invention provides a reading card that can be used to read or understand the markings on a golf club face. Such reading card may indicate whether the golf club hit the ball straight, sliced, hooked, the relative force or speed of the golf club, etc.

Also provided is a computer program and/or online system that instruct users how to read the marking on the golf club and how to correct his/her swing based on these markings.

A golf swing practice apparatus is provided including (a) a golf ball simulation target, (b) a supporting member for supporting the target, the support member adapted to anchor the target, the target being movable relative to the supporting member between a normal configuration and an impacted configuration when impacted by a golf club head during a golf practice swing, (c) a connector arm connecting the target to the supporting member, and (d) a marker supported by the target and adapted to mark the face of the golf club head when the face impacts the target during the golf practice swing and with the target in the anchored position. The connector arm may be offset a central line of the target a horizontal distance from a central axis of the support member. The arm may be configured to be raised or lowered relative to the supporting member to adjust the height of the target relative to a support surface.

The supporting member may include a stake adapted to allow a user to manually push the stake into the ground and pull the stake out of the ground.

The target includes a round member whose outer diameter is approximately the same as the diameter of a golf ball simulated by the target. The target may have a spherical shape approximately the size of a golf ball or a semi-spherical shape approximately the size of half a golf ball. The marker may be a print marker that includes a body containing marking liquid or marking gel. The marker may also include a plurality of print strips that, when the target is impacted by a golf club head, makes one or more marks on the golf club head. The one or more marks indicate the orientation of the golf club head relative to the target and/or the relative force with which the target is struck. The one or more marks may indicate the relative force with which the target is struck. The target is adapted to resiliently spring back after it is impacted by a golf club during the practice swing.

Another embodiment provides, a golf swing practice apparatus, comprising: (a) a golf ball simulation target attachable in a golf swing practice position to a support member, (b) a first marker connected to the target to mark a golf club head with a first mark during a golf practice swing on the target, and (c) a second marker connected to the target to mark the golf club head with a second mark during the golf practice swing.

The first and second marks may be substantially parallel to one another. The first and second marks can be used to determine whether the golf practice swing was a square, open, or close faced swing at impact of the golf ball simulation target to the golf club head. The first and second marks may also indicate the proximate position where the golf club head would have contacted a real golf ball. When the first mark is longer than the second mark, a close face impact of the golf club head is indicated, and when the first mark is shorter than the second mark, an open face impact of the golf club head is indicated. Different lengths of the first and second marks indicate an open or close face impact by the golf club head and equal lengths of the marks indicate a square hit by the golf club head. The average lengths of the first and second marks indicate the relative speed of the golf club head at impact with the golf ball simulation target. The first and second markers may be print strips formed as part of a replaceable cartridge.

Yet another feature provides a golf practice swing marker, comprising: (a) a body of elastic material, and (b) a marking fluid held in the body by wicking or capillary action and adapted to mark a face of a golf club head when the body comes in contact with the golf club head during a golf practice swing. The marking fluid is a marking ink or dye whose mark on the golf club head face is adapted to be wiped off of the golf club head face by a wiping action of a user. The body comprises wicking material, retriculated foam, capillary foam, sponge or retriculated felt. The body is adapted to be coupled to a golf swing practice apparatus.

A golf swing practice reader apparatus is also provided comprising: (a) a reading card, (b) a distance and angle indicator, (c) a pin coupled the distance and angle indicator and the reading card, the distance and angle indicator and reader card including markings for reading the amount of hook or slice impact by a golf club from marks on the club head face when the distance and angle indicator is in position relative to the club head face. The distance and angle indicator is in a first position relative to the face when the reading card is reading the amount of hook impact and in a different second position when the reading card is reading the amount of slice impact. The pin may rotate and slide relative to the reading card. The distance and angle indicator may be a windmill indicator. The reading card includes first and second windows and the distance and angle indicator is pivotable and slidable relative to the windows during a reading process.

Other objects and advantages of the present invention will become more apparent to those persons having ordinary skill in the art to which the present invention pertains from the foregoing description taken in conjunction with the accompanying drawings.

DETAILED DESCRIPTION

In the following description, specific details are given to provide a thorough understanding of the embodiments. However, it will be understood by one of ordinary skill in the art that the embodiments may be practiced without these specific details. For example, circuits may not be shown in block diagrams in order not to obscure the embodiments in unnecessary detail.

In the following description, certain terminology is used to describe certain features of one or more embodiments of the invention. The term "target" (e.g., golf ball simulation target) refers, but is not limited, to any object or shape intended to be struck by a golf club or serve as an aim for a golf club swing. The terms "print media" and "marker" (e.g., marking cartridge, etc.) refer to anything that holds or includes a marking fluid, gel, or substance and can transfer a mark onto a golf club head. The term "print strip" is one type of print media which has an elongated shape.

One example of the invention provides a golf swing practice system with visual indications of a realistic golf club practice swing quality (e.g., straight, slicing, hooking, undercutting, topping, etc.). The golf swing practice system is a compact apparatus that can be deployed indoors and/or outdoors and provides a user the sensation, sound and/or feel, of striking a real golf ball with a club. Upon striking a golf ball simulation target, the golf club face is marked with one or more indicators of the position of the golf club face relative to golf ball simulation target. These one or more indicators can then be used to determine the golf club swing characteristics.

Another aspect of the invention provides different ways of marking a golf club face to convey the type of contact between a golf ball simulation target and a golf club face. Such markings made on the golf club face may serve to diagnose various characteristics of the golf swing.

Another feature of the invention provides various types of markers that can be used to deposit markings on a golf club face as indicators of a golf swing.

Yet another feature of the invention provides a reading card that can be used to read or understand the markings on a golf club face. Such reading card may indicate whether the golf club hit the ball or golf ball simulation target square (straight), open (sliced), and/or closed (hooked) at impact.

Also provided is a computer program and/or online system that instruct users how to read the marking on the golf club and how to correct his/her swing based on these markings.

Figure 1:
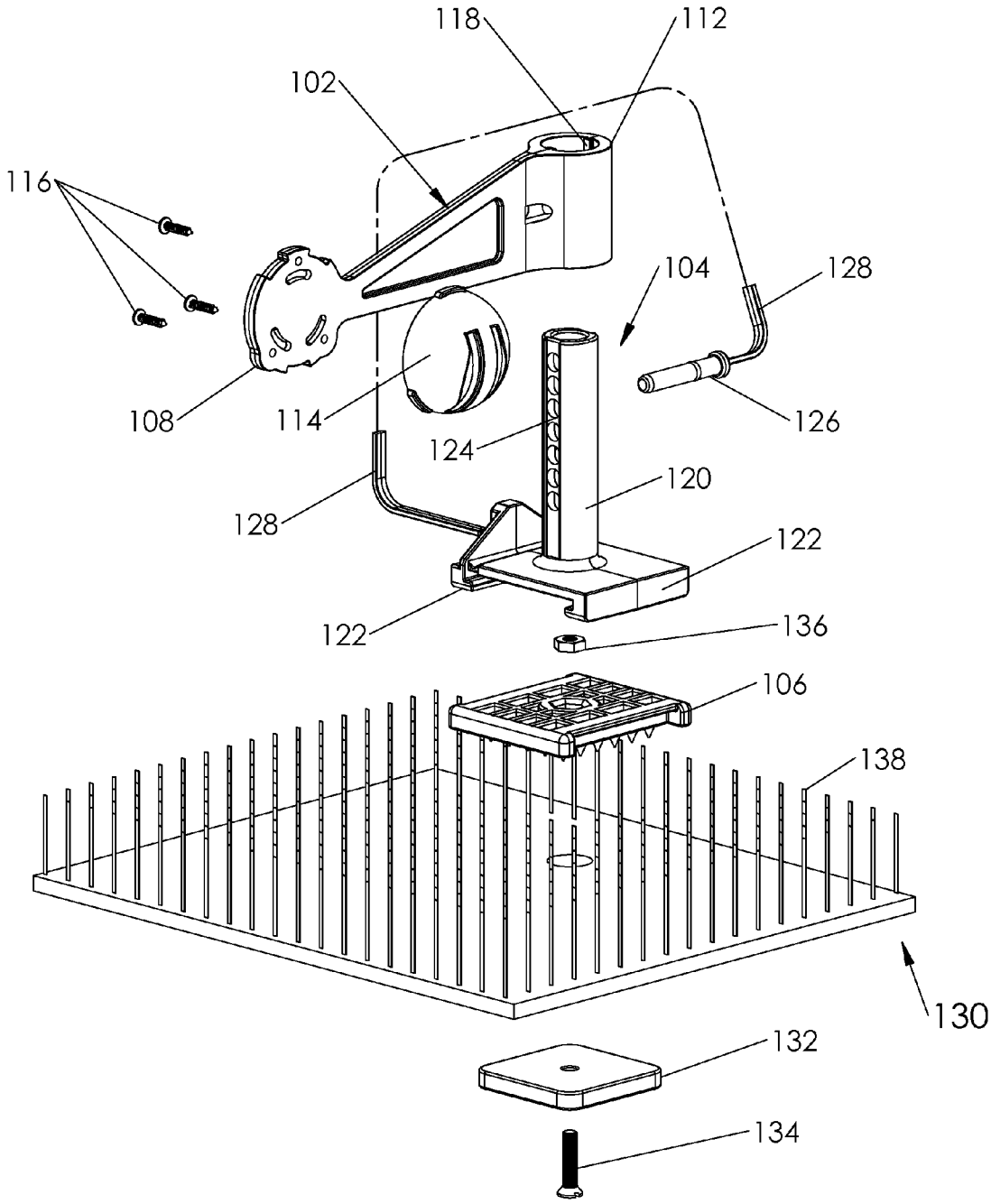
FIG. 1 illustrates an exploded view of a golf swing practice apparatus according to one embodiment of the present invention.

FIG. 1 illustrates an exploded view of a golf swing practice apparatus according to one embodiment of the present invention. The golf swing practice apparatus includes an extension arm 102 coupled to a supporting member 104. The extension arm 102 includes a target base 108 at one end and a mounting coupler 112 at the opposite end of the extension arm 102. A practice target 114 couples to the target base 108 using fasteners 116, interlocking tabs, and/or other securing mechanisms. The mounting coupler 112 may define an opening 118 that receives the supporting member 104.

The supporting member 104 includes a shaft or post 120 coupled to a base 122. When assembled, the post or shaft 120 slides through the opening 118 in the mounting coupler 112 to support the arm 102. In one embodiment, the shaft 120 may include a plurality of holes 124 which receive a pin 126 to adjust the height at which the practice target 114 is mounted relative to a mounting surface. For example, when inserted into one of the plurality of holes 124, the pin 126 may support the mounting coupler 112 at a fixed height relative to the support surface. For instance, the bottom edge of the target 114 may be positioned on or adjacent to the practice or support surface to simulate a fairway shot. Alternatively, the bottom edge of target 114 may be spaced a distance, such as one inch, above the support surface to simulate a "teed-up driving" shot. It can also be positioned in between, such as for a "par three" or near support surface shot. The pin 126 may be coupled to the supporting member 104 by a tether 128 so that it is not lost or misplaced when removed from the shaft holes 124.

In some implementations, the mounting coupler 112 may also include an opening through which the pin 126 can pass to reach holes 124 on the shaft or post 120. In some embodiments, the pin 126 passing through both the mounting coupler 112 and the shaft 120 prevents the mounting coupler 112 from rotating when the practice target 114 is struck. In other implementations, the shaft 120 may have a non-circular cross-section or includes a keyed cross-section that corresponds to the internal contour of the opening 118 thereby preventing the mounting coupler 112 from rotating while adjusting the height of 102 or when the practice target 114 is struck.

The base 122 may include an attaching/detaching mechanism that permits the golf swing practice apparatus to be mounted on different supporting surfaces. For example, a golf practice mat 130 may serve as the supporting surface for the golf swing practice apparatus. A mounting base 106 positioned on one side of the mat 130 is coupled to a backing plate 132 on the opposite side of the mat 130 by a fastener 134 and retaining nut 136. Other mounting or retaining mechanisms may also be employed without departing from the invention. The base 122 can then be coupled to the mounting base 106. This mechanism permits setting the practice target 114 at the surface of the practice mat 130 or below or above the top of the practice grass 138.

Figure 2:
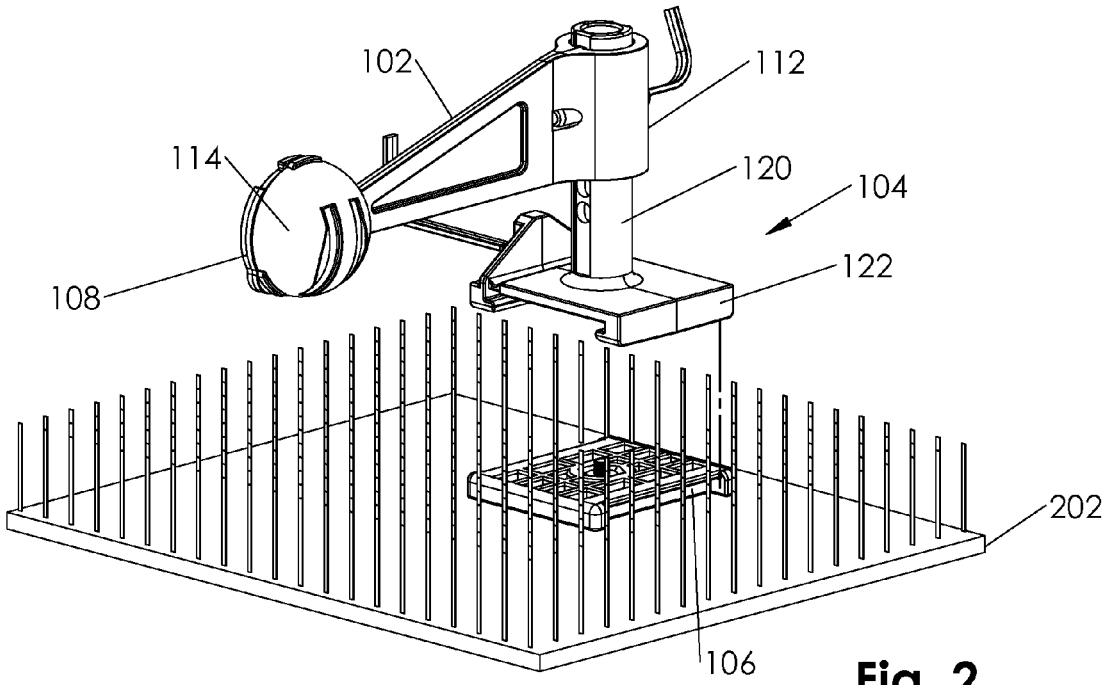
FIG. 2 illustrates a perspective view of the golf swing practice apparatus of FIG. 1, as it is stalled on a practice mat.

FIG. 2 illustrates a perspective view of the golf swing practice apparatus of FIG. 1, with the assembled extension arm 102 and supporting member 104, separated from the mounting base 106 on a practice mat 202. Since the various parts of the golf swing practice apparatus, including the target 114, base 108, arm 102, coupler 112, shaft/post 120, pin 126, base 122, and/or backing plate 132, may be intentionally or accidentally struck by a golf club (e.g., when a golfer misses the target and hits a different part of the golf swing practice apparatus), these parts may be constructed from sufficiently strong and/or flexible materials capable of withstanding such forces. For instance, the shaft 120 may be made from an elastic material that allows the shaft 120 to flex if struck directly by a golf practice swing. This increases the durability and/or life of the golf swing practice apparatus.

Figure 3:
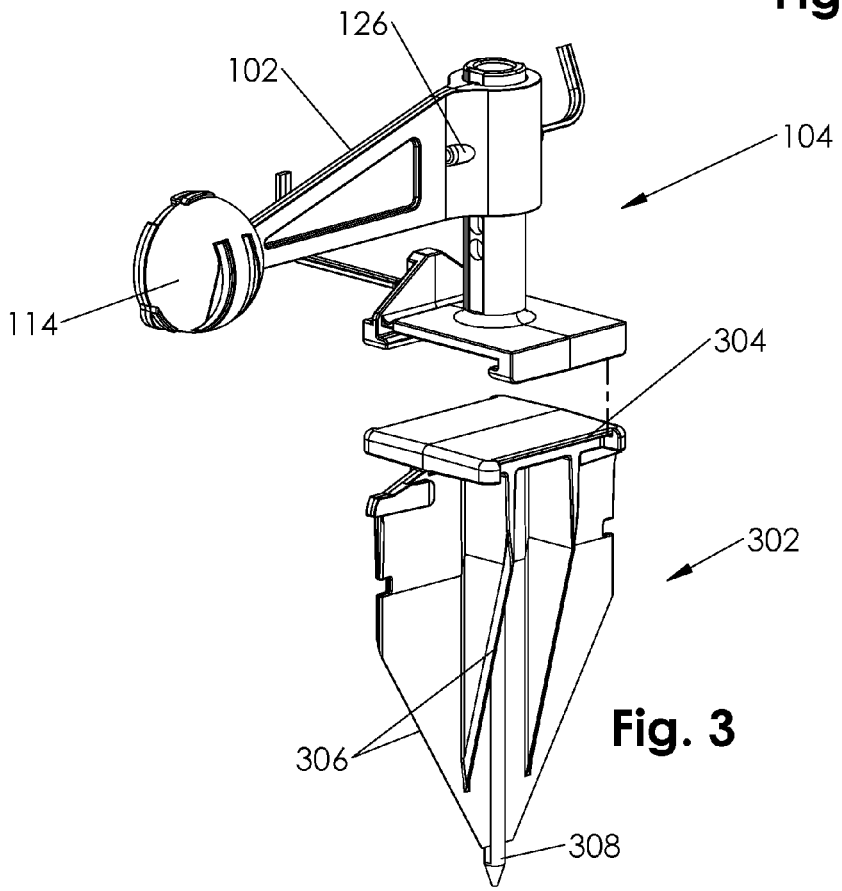
FIG. 3 illustrates a perspective view of another version of the invention having a ground stake mounting mechanism.

FIG. 3 illustrates a perspective view of another version of the invention having a ground stake mounting mechanism. The arm 102 and supporting member 104 for the golf swing practice apparatus of FIG. 1 are illustrated in an assembled state. However, in this illustration a ground stake 302 is used as the mounting mechanism. That is, the base 122 couples to a mounting base 304 of the ground stake 302 to provide support to the golf swing practice apparatus. The ground stake 302 may include one or more fins 306 extending from a center pin 308. A player can simply press the ground stake 302 into the ground and then couple the base 122 to the mounting base 304. The base 122 may include guides that couple, snap, and/or slide into matching rails on the mounting base 304 to secure the supporting member to the ground stake 302. So that the golf swing practice apparatus may withstand the significant forces of a practice golf swing when any part of the apparatus is struck, one embodiment provides for the base 122 to be detachable from the mounting base if sufficient force is applied (e.g., a golf practice swing accidentally strikes the shaft 120 directly). This prevents the ground stake 302 and/or other parts of the golf swing practice apparatus from breaking under the significant forces generated by a golf practice swing.

Figure 4:
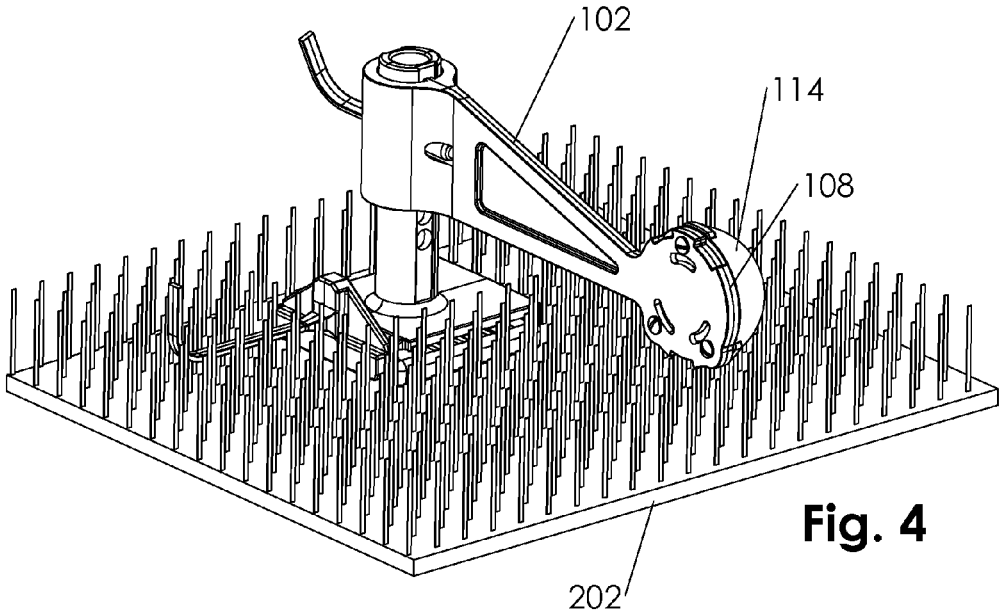
FIGS. 4 and 5 illustrate the right-handed and left-handed mounting positions of a golf ball simulation target, respectively.
Figure 5:
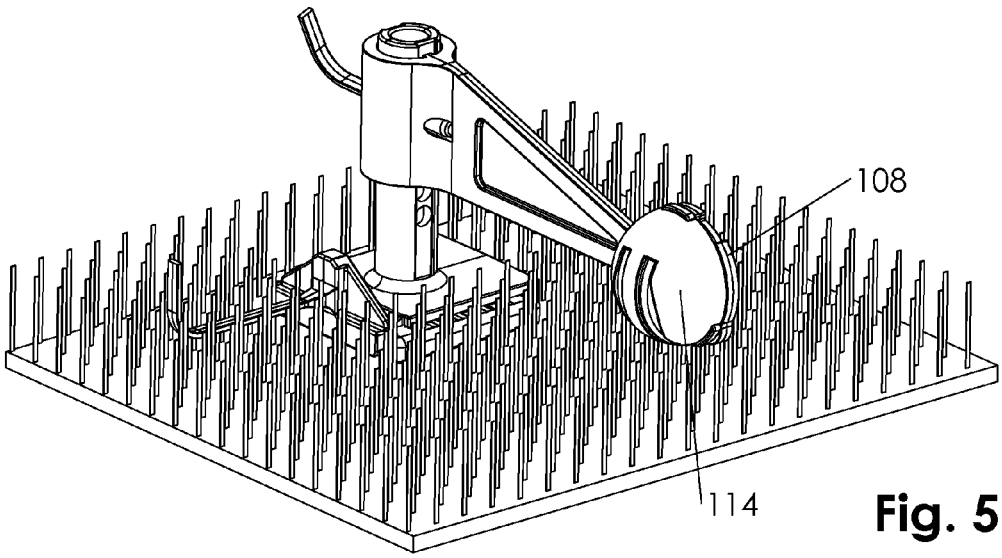

FIGS. 4 and 5 illustrate the right-handed and left-handed mounting positions of a golf ball simulation target 114, respectively. That is, FIG. 4 illustrates how the practice target 114 is positioned on a first face of the target base 108 for right-handed golf club swinging. The practice target 114 maybe detached from the first face of the target base 108 and coupled to the opposite face of the target base 108 to accommodate a left-handed golf swing.

Figure 6:
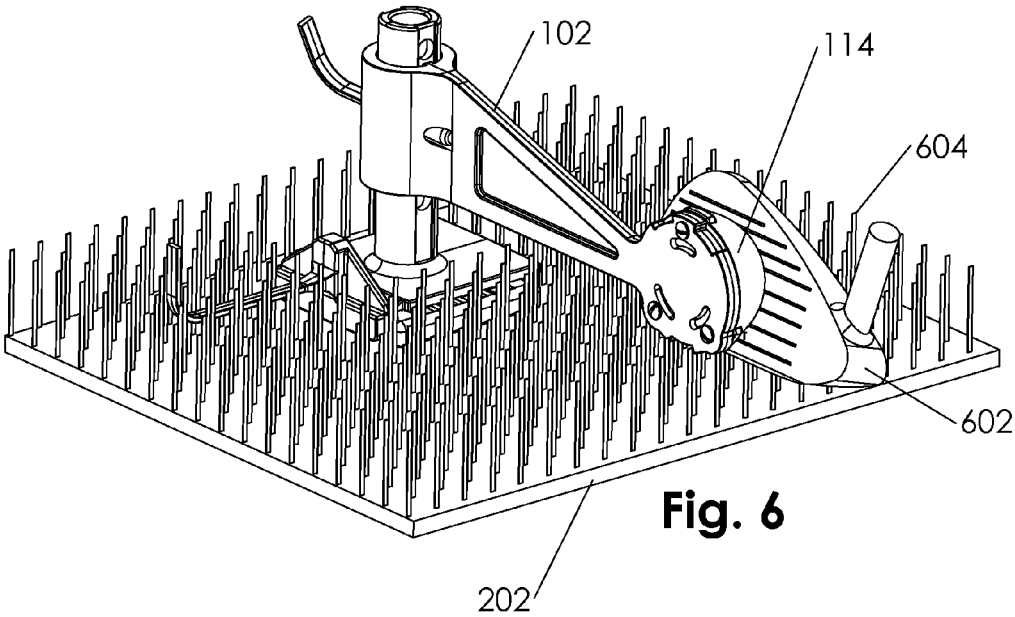
FIGS. 6 and 7 illustrate how different types of golf clubs may be used with the golf swing practice apparatus.
Figure 7:
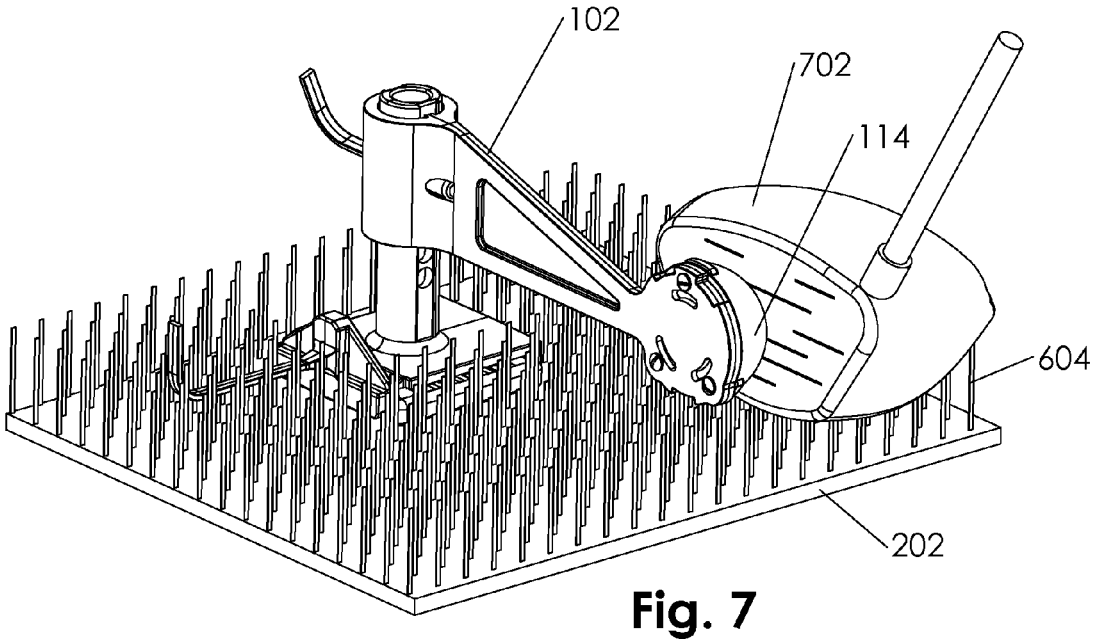

FIGS. 6 and 7 illustrate how different types of golf clubs may be used with the golf swing practice apparatus. FIG. 6 illustrates how a four iron golf club may be used to practice on the golf swing practice apparatus. Similarly, FIG. 7 illustrates the use of a driver golf club to practice on the golf swing practice apparatus. It should be noted that the arm 102 may be lowered or raised relative to the playing mat 202 or supporting surface according to the desired practice height of the target 114. For instance, FIG. 6 illustrates how the target 114 is placed at the level of the simulated playing turf 604 for practicing with the four iron golf club 602. In another example, FIG. 7 illustrates how the arm 102 is raised to place the target 114 at a height similar to a tee for practicing with the driver golf club 702.

Figure 8:
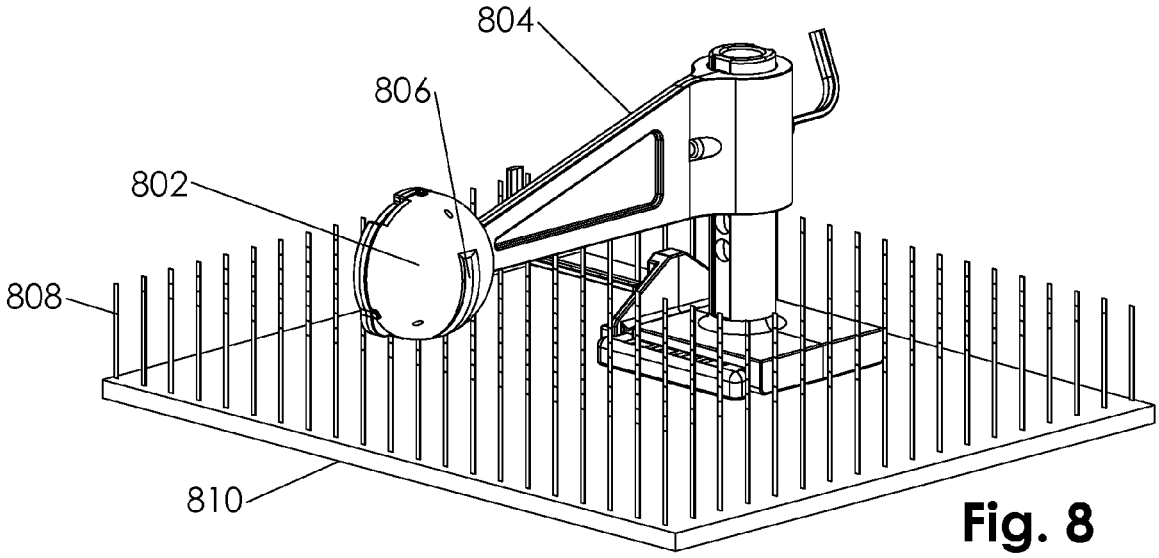
FIG. 8 illustrates an alternative golf ball simulated target coupled to an extension arm having a single marking or printing strip.

FIG. 8 illustrates an alternative golf ball simulated target 802 coupled to an extension arm 804 having a single marking or printing strip 806. Such single marking strip 806 maybe used to ascertain the relative force with which a golf club strikes the practice target 804 as well as the position at which the golf club head contacts the practice target 804. In other embodiments, rather than using one or more vertical marking strips, the marking strips may have a horizontal or diagonal, or a combination of horizontal, diagonal, and/or vertical marking strips. Additionally, rather than using strip shapes, the marking element(s) may have other shapes, including one or more dots, squares, triangles, circles, etc.

Figure 9:
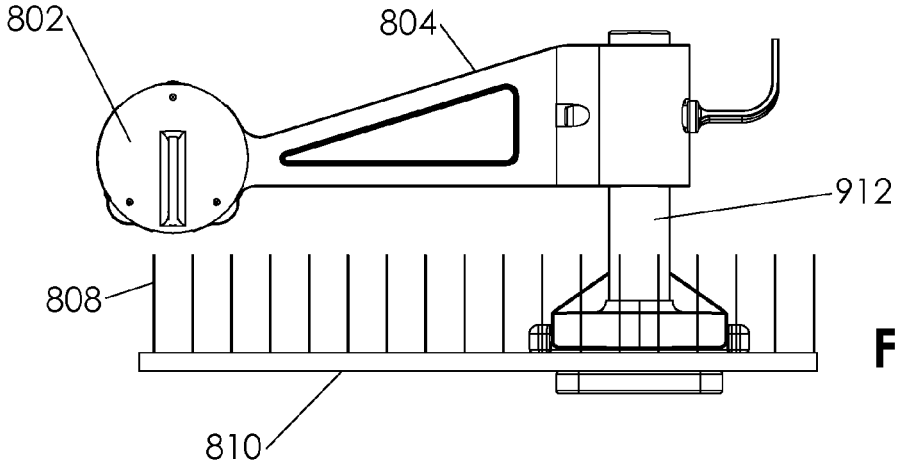
FIGS. 9 and 10 illustrate how the height of a target can be adjusted (e.g., raised or lowered) as desired.
Figure 10:
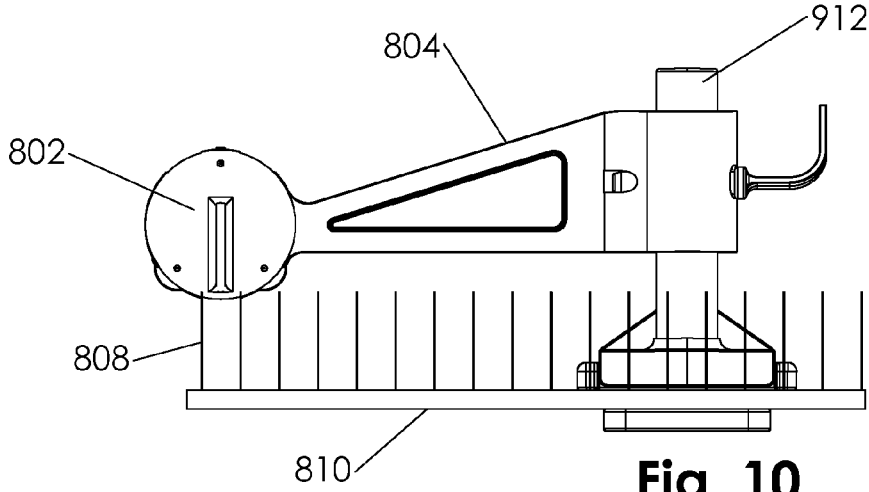

FIGS. 9 and 10 illustrate how the height of a target can be adjusted (e.g., raised or lowered) as desired. That is, FIG. 9 illustrates how the practice target 802 may be placed at a first height (e.g., to simulate a golf ball placed on a tee). FIG. 10 illustrates how the practice target 802 may be lowered to the level of the grass 808 on practice mat 810 (e.g., to simulate hitting the golf ball on the playing surface or fairway). This height adjustment may be performed by sliding the extension arm 804 up or down on the supporting post 912 and securing it at the desired height.

Figure 11:
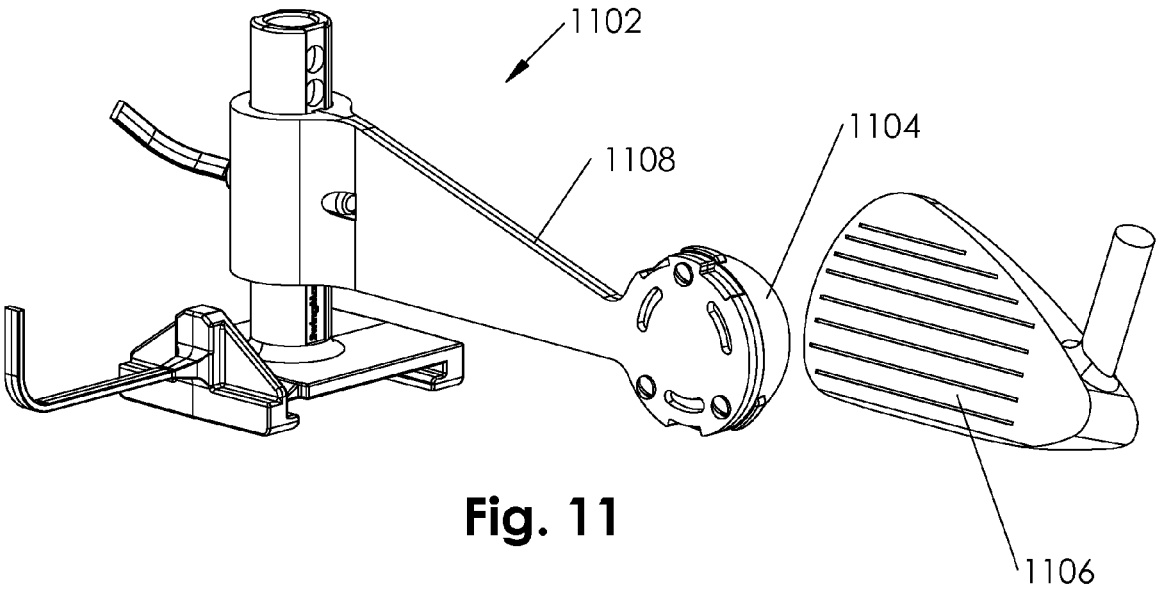
FIGS. 11 and 12 illustrate the operation of a golf swing practice apparatus.
Figure 12:
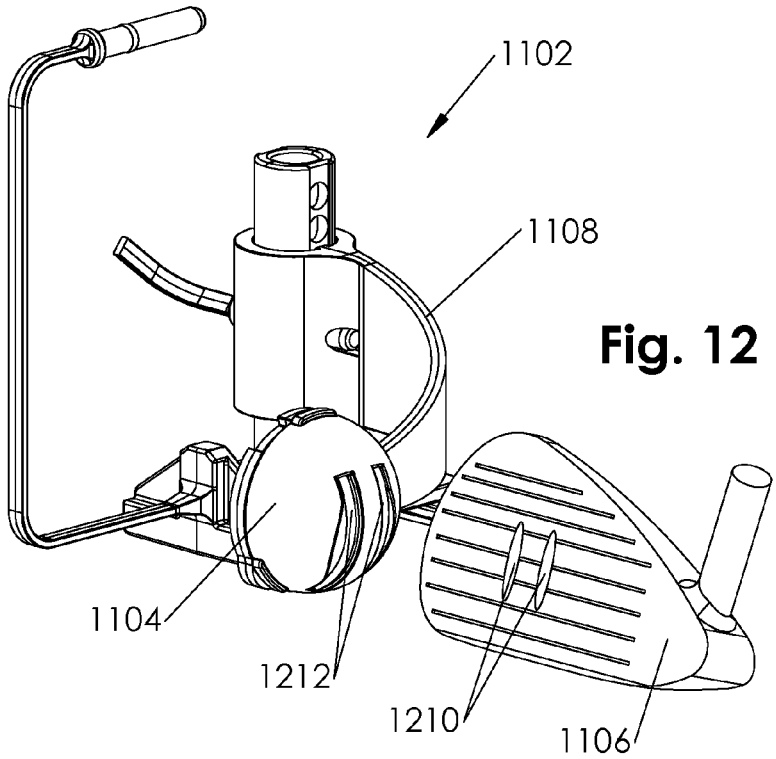

FIGS. 11 and 12 illustrate the operation of a golf swing practice apparatus. FIG. 11 illustrates a golf swing practice apparatus 1102 prior to the practice target 1104 being struck by the face of a golf club 1106. FIG. 12 illustrates the golf swing practice apparatus 1102 after the practice target 1104 has been struck by the face of a golf club 1106. The arm 1108 flexes backwards when struck and the print strips 1212 on the practice target 1004 leave print marks 1210 on the face of the golf club 1106. The arm 1108 may flex back into its original position after the golf club 1106 passes. In other implementations, the arm 1108 may rotate completely or partially about its supporting post instead of or in addition to flexing.

In yet other embodiments, a different supporting mechanism may be employed. For example, the practice target may be tethered or supported by a vertical arm, rather than the horizontal extension arm 1108 illustrated in FIGS. 11 and 12. When struck by a golf club, the target travels in a vertical trajectory instead of a horizontal trajectory.

Figure 13:
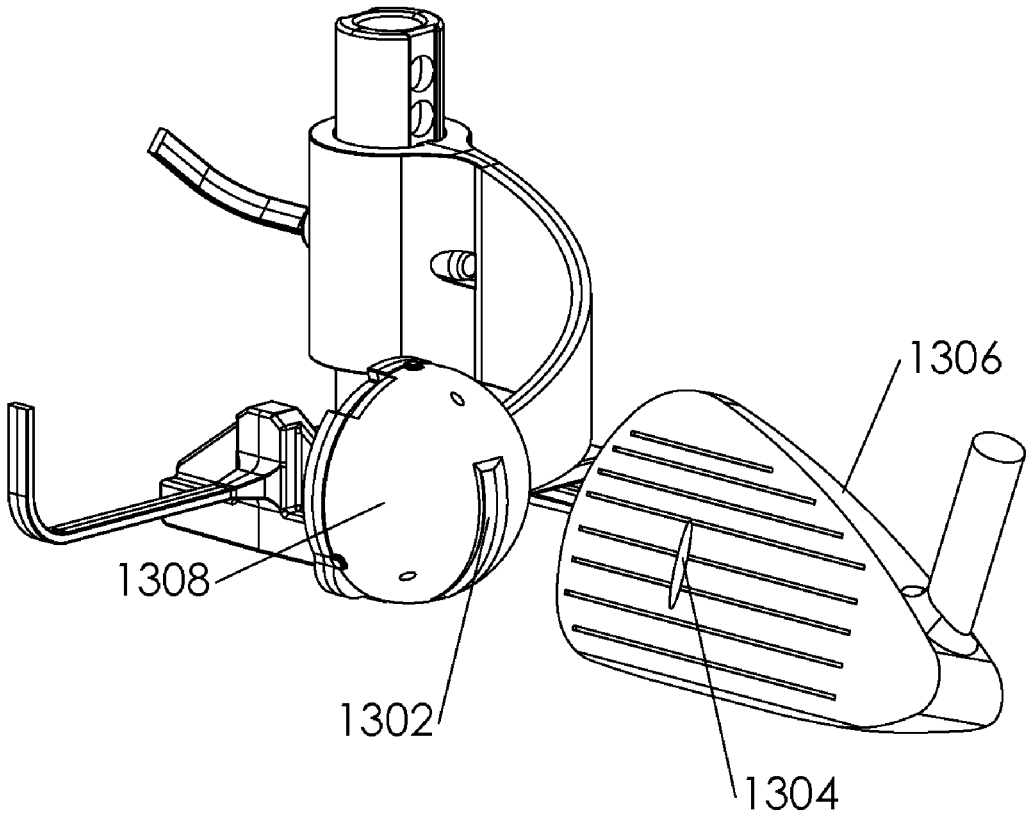
FIG. 13 illustrates an alternative golf ball simulated target having a single marking or printing strip after it is struck by a golf club.

FIG. 13 illustrates an alternative golf ball simulated target having a single marking or printing strip after it is struck by a golf club. The single marking strip 1302 makes a mark 1304 at the point at which it contacts the golf club head 1306, thereby simulating where the golf club would contact a real ball. The length and/or width of the mark 1304 may be indicative of the force with which the target 1308 is struck. Additionally, this mark provides an indication of where the target 1308 was struck relative to a sweet spot of the golf club head.

Figure 14:
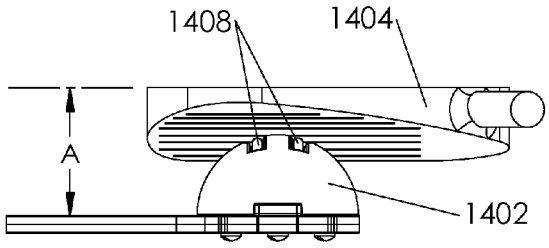
FIGS. 14 and 15 illustrate a square impact of the golf ball simulated target by the golf club head.
Figure 15:
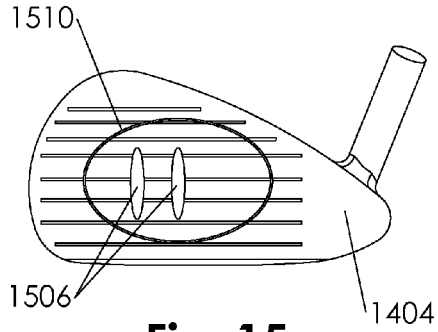

FIGS. 14 and 15 illustrate a square face (straight) impact of the golf ball simulated target 1402 by the golf club head 1404. In a square face impact, the angle A between the golf club head and the arm or tangent line at the point of impact is zero. As noted in FIG. 15, two marks 1506 are made by the marking strips 1408 near the center of the sweet spot 1510 for the golf club head 1404. Because these marks 1506 are approximately the same size, this indicates a substantially straight or square impact and translates to a straight direction for the trajectory of a real golf ball.

Figure 16:
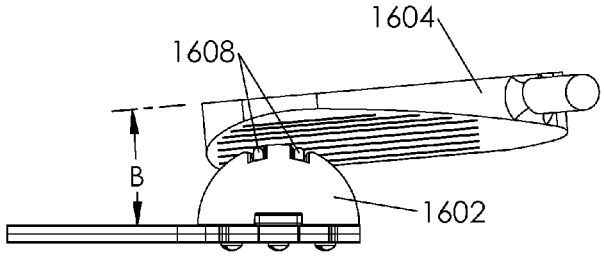
FIGS. 16 and 17 illustrate a closed club face (hooked) impact of the golf ball simulated target by a golf club head.
Figure 17:
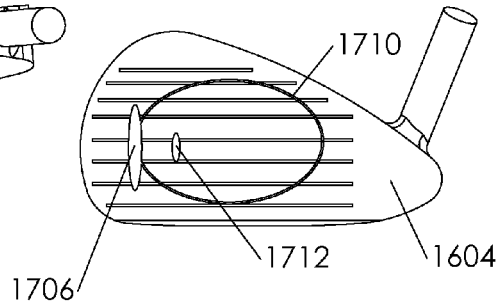

FIGS. 16 and 17 illustrate a closed face (hooked) impact of the golf ball simulated target 1602 by a golf club head 1604. In a close face impact, the angle B between the golf club head and the arm or tangent line at the point of impact is greater than zero. As noted in FIG. 17, two marks 1706 and 1712 are made by the marking strips 1608 offset from the sweet spot 1710 of the golf club head 1604. Because these marks 1706 and 1712 are different sizes and the outer mark 1706 is longer than the inner mark 1712, this indicates a close club face (hooked) swing at an offset impact point.

Figure 18:
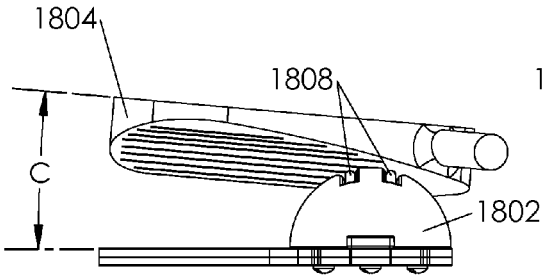
FIGS. 18 and 19 illustrate a open club face (sliced) impact of a golf ball simulated target by the golf club head.
Figure 19:
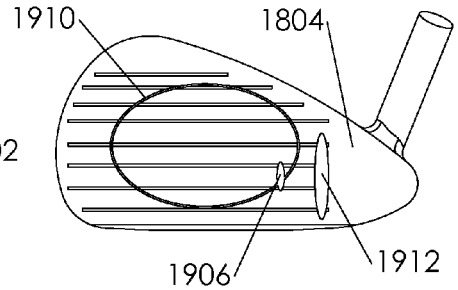

FIGS. 18 and 19 illustrate an open club face (sliced) impact of a golf ball simulated target 1802 by the golf club head 1804. In an open face impact, the angle C between the golf club head and the arm or tangent line at the point of impact is greater than zero. As noted in FIG. 19, two marks 1906 and 1912 are made by the marking strips 1808 offset from the sweet spot 1910 of the golf club head 1804. Because these marks 1906 and 1912 are different sizes and the inner mark 1912 is longer than the outer mark 1906, this indicates an open club face (sliced) swing at an offset impact point.

Figure 20:
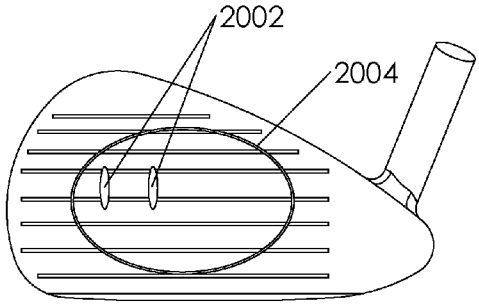
FIGS. 20-27 illustrate various combinations of markings made using dual print strips of the present invention and their significance is in terms of swing orientation and force.
Figure 21:
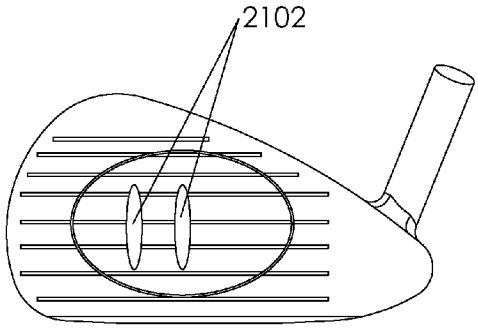
Figure 22:
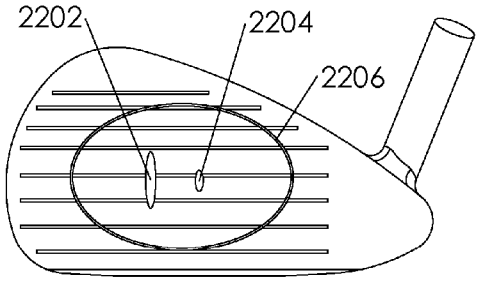
Figure 23:
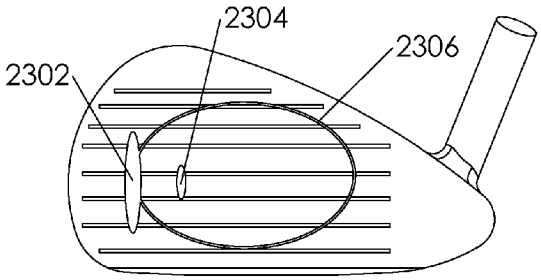
Figure 24:
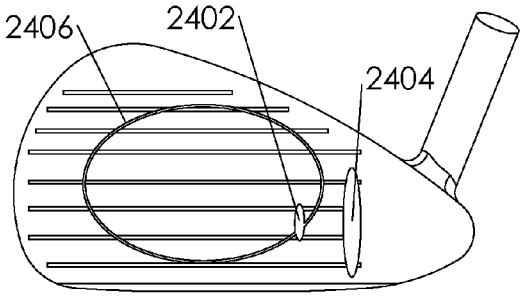
Figure 25:
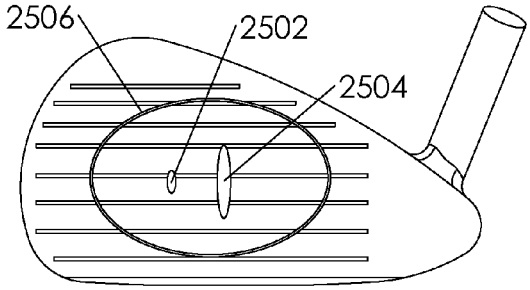
Figure 26:
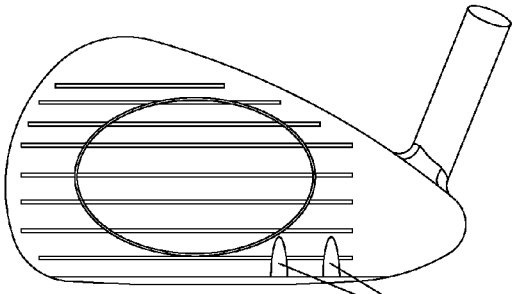
Figure 27:
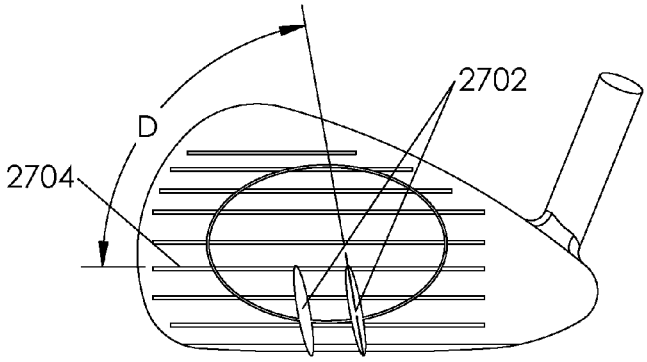

FIGS. 20-27 illustrate various combinations of markings made using dual print strips of the present invention and their significance is in terms of swing orientation and force. FIGS. 20 and 21 illustrate marks on the face of a golf club indicating a light and heavy straight and square impact, respectively, positioned relative to a sweet spot 2004. That is, the shorter marks 2002 on FIG. 20 indicated a lighter impact than the longer marks 2102 on FIG. 21. FIGS. 22 and 23 illustrate marks on the face of a golf club indicating a hard hook with a light and heavy impact, respectively. That is, in FIG. 22 the longer mark 2202 toward the outer edge of the golf club head relative to the shorter mark 2204 toward the inner edge of the golf club head indicates a hard hook with a light impact in the center of the sweet spot 2206 of the golf club head. In FIG. 23, the longer mark 2302 toward the outer edge of the golf club head relative to the shorter mark 2304 toward the inner edge of the golf club head indicates a hard hook with a heavy impact on the edge of the sweet spot 2306 of the golf club head. In contrast, FIGS. 24 and 25 illustrate marks on the face of a golf club indicating, respectively, an open face (sliced) shot positioned offset from sweet spot 2406 and an open faced (sliced) shot within sweet spot 2506. That is, in FIG. 24 the longer mark 2404, toward the inner edge of the golf club head, relative to the shorter mark 2402, toward the outer edge of the golf club head, indicates a hard slice with heavy impact near the inner edge of the sweet spot 2406. In FIG. 25 the longer inner mark 2504 and shorter outer mark 2502 indicate a hard slice at the center of the sweet spot 2506. That is, the difference between the lengths of the two marks can be used to determine whether a swing is a hard or light close face (hook) or open face (slice) swing. Meanwhile, the average length of the two marks can be used to determine the relative club head speed during a close face (hook) or open face (slice) swing. FIG. 26 illustrates two partial marks 2602 near the bottom edge of the golf club head which is indicative of a golf ball being topped (i.e., golf club head contacted the golf ball or target too high). In FIG. 27, the angled marks 2702 may indicate that the player is standing too far from the ball or that the golf club is too long. That is, a lie angle D formed between the longitudinal axis of the marks 2702 and vertical alignment lines 2704 (e.g., ball grip grooves) on the face of the golf club head can be used to diagnose various conditions. For instance, if the angle D is approximately ninety degrees, this indicates a proper golf club length and swing stance distance. On the other hand, if the angle D is less than ninety degrees, this indicates that the golf club is too long or that the player is standing too far from the ball/target. According to one feature of the invention, one or more of the printing strips may have different color ink and/or shapes so that the markings on a golf club face can be easily distinguished by their different colors. In one implementation, the ink may be selected so that it evaporates after an amount of time after the swing (e.g., 30 seconds, 1 minute, etc.) thereby avoiding the need to swipe the surface clean prior to taking another swing.

Since the practice target 114 (FIG. 1) is tethered, a golfer can get real-life practice swings and feedback information on the swing without the necessity of using a real golf ball that must take flight to show the effects of a swing. Even a real golf ball will not indicate the quality of the swing to the degree of the present invention since golf balls do not print a mark on the club face that provide information about a swing. The footprint of a mark indicates the quality of the swing thereby providing realism without large space requirements.

Figure 28:
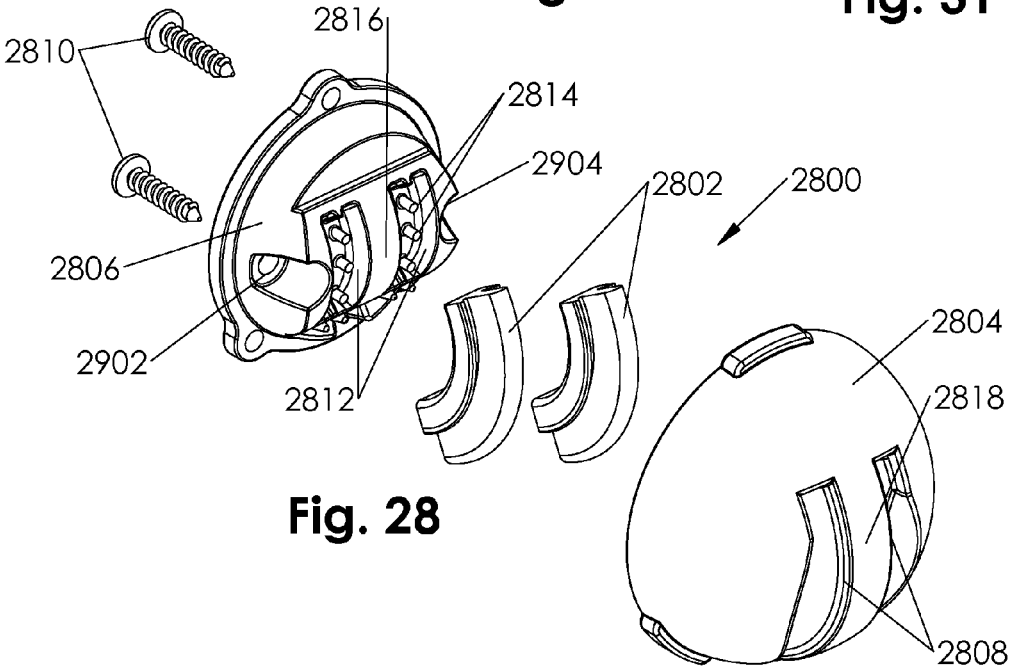
FIG. 28 illustrates an exploded view of a practice target or cartridge assembly according to one implementation.

FIG. 28 illustrates an exploded view of a practice target or cartridge assembly 2800 according to one implementation. The cartridge assembly 2800 may have a spherical or semi-spherical shape to resemble the size, look and feel of a real golf ball. In this embodiment, two print strips 2802 are securely held in place within a cartridge assembly 2800 formed by a cover 2804 and a rear plate 2806. The print strips 2802 may be straight but bend or adapt to a curved form when inserted in the cartridge assembly 2800. The print strips 2802 are located on or near the surface of the practice target 2800 through openings 2808 in the cover 2804. The rear plate 2806 may be shaped to press substantially evenly on the print strips 2802. The cartridge assembly 2800 is formed by the rear plate 2806 and cover 2804 coupled together with the print strips 2802 securely housed therein. The cover 2804 may be made of a sufficiently tough and/or resilient material to withstand being struck by a golf club.

Figure 29:
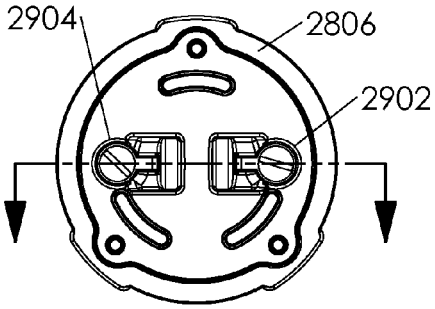
FIGS. 29, 30, and 31 illustrate a back view, a side view and a frontal view, respectively, of the practice target or cartridge assembly, respectively, according to one implementation.
Figure 30:
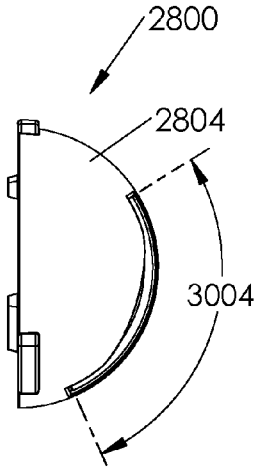
Figure 31:
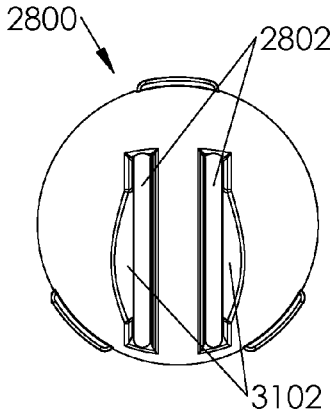

FIGS. 29, 30, and 31 illustrate a back view, a side view and a frontal view, respectively, of the cartridge assembly 2800 according to one implementation. FIG. 29 illustrates a back view of the cartridge assembly having symmetric openings 2902 and 2904 through which fastening screws 2810 can pass to secure the rear plate 2806 to print strips 2802 and the cover 2804 together. FIG. 30 illustrates how the print strips 2802 extend vertically over a significant portion 3004 of the face of the cover 2804. By extending over such vertical arcuate length 3004, the print strips 2802 are able to make contact with different types of golf clubs that may strike the practice target or cartridge assembly 2800 at different points or angles. The length 3004 of the print strips 2802, extending from near the bottom point of the target 2800 to above the mid-point of the target 2800, insures that impact marks made on the golf club head represent a substantially realistic region at which the golf club head would have impacted a real golf ball. In reality, a golf club head would impact a real golf ball in between these two marks. The practice target or cartridge assembly 2800 is similar in shape, hardness, and mass of a real golf ball to provide a realistic sensation (e.g., impact, feel, and/or sound) during a practice swing. In alternative implementations, one or more print strips may be positioned horizontally, vertically, diagonally or a combination thereof. Additionally, instead of strips, the marking element may have different shapes, such as round, square, triangular, etc., and/or different lengths or sizes.

Figure 32:
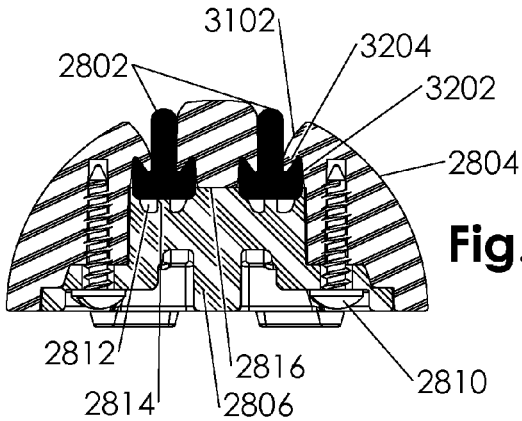
FIG. 32 illustrates a cross-sectional view of the assembled practice target or cartridge assembly according to one implementation.

The print strips 2802, holding the printing or marking fluid, are resilient and thus are affected by the acceleration during impact. To prevent the print strips 2802 from popping out when the practice target or cartridge assembly is struck by a golf club, various securing mechanisms may be employed. For example, FIG. 32 illustrates a cross-sectional view of the assembled practice target 2800 according to one implementation. The rear plate 2806 tightly presses the print strips 2802 against the inner surface of the cover 2804, with the tips of the print strips 2802 positioned within openings 2808 in the cover 2804. To secure the print strips 2802 within the practice target 2800, the print strips 2802 include grooved winged edges 3202 that interlock with corresponding retaining grooves 3204 on the inner surface of the cover 2804, adjacent the interior longitudinal edges of the openings 2808.

Because the target or cartridge assembly 2800 will be exposed to significant forces when struck by a practice golf swing, it is designed to absorb and withstand these forces while safeguarding the print strips 2802 and providing the feel or sensation of a real golf ball when struck by a practice golf swing. For this purpose, one embodiment of the rear plate 2806 and cover 2804 are configured to absorb the impact of a practice golf swing. In particular, the cover 2804 includes a primary impact region 2818 between the openings 2808. The interior of the impact region 2818 is in direct contact with an impact absorption region 2816 in the rear plate 2806 so that the force of a practice golf swing is transferred to the rear plate 2806. The interior rear plate 2806 is curved to provide curvature to the print strips 2802. The interior of the rear plate 2806 may also include recessed zones or grooves 2812 to receive the print strips 2802. A plurality of support posts 2814 creates a space between the recessed zones 2812 and print strips 2802. This space allows the print strips 2802 to move into the recessed grooves 2812 when the target 2800 is struck with sufficient force to cause the cover retaining grooves 3204 to press on the grooved winged edges 3202. Allowing the print strips 2802 to move into the recessed grooves 2812 prevents them from being cut or damaged by the cover retaining grooves 3204 when the target 2800 is struck by a golf club. When the target 2800 is struck, the retaining grooves 3204 press on the winged edges 3202 causing them to bend into the recessed grooves 2812.

One problem that may be encountered when the target 2800 is struck with exceptional force by a golf club is that the impact region 2818 and/or impact absorption region 2816 may compress sufficiently that the golf club head also contacts the outer edges of the cover openings for the print strips. If this occurs, the sides of these openings would squeeze and/or deform the print strips 2802. To avoid this problem, one embodiment of the invention provides openings 2808 having rounded outer edges 3102. By rounding the outer edges 3102 as shown, the golf club head is less likely to come into contact with these outer edges 3102, thereby avoiding damage, squeezing, and/or deformation to the print strips 2802.

Figure 33:
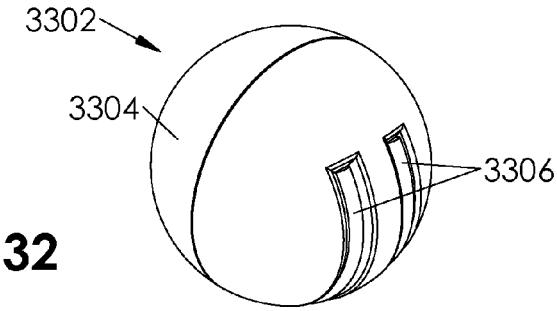
FIG. 33 illustrates yet another embodiment of a practice target which has a spherical shape to more closely resemble a real golf ball.

FIG. 33 illustrates yet another embodiment of a practice target 3302 which has a spherical shape to more closely resemble a real golf ball. This spherical target 3302 may be created, for example by adding a semi-spherical rear cover 3304 to the semi-spherical target 114 illustrated in FIG. 1. In an alternative embodiment, the target 3302 may be a free-flying golf ball having printing markers 3306 that operate to mark the golf club face as previously described.

Figure 34:
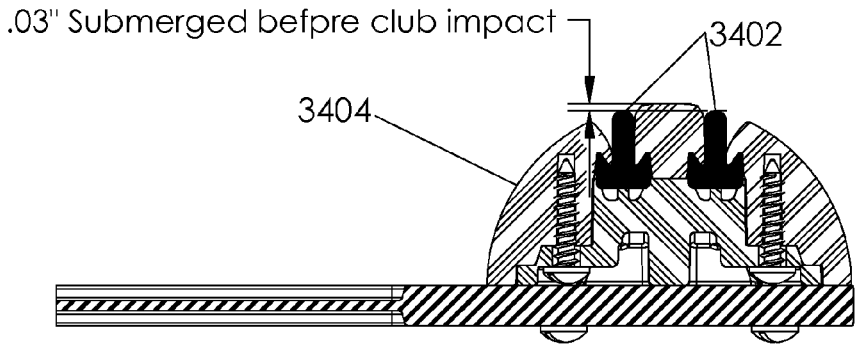
FIG. 34 illustrates the typical state of the print strips in a one embodiment of a practice target or cartridge assembly.
Figure 35:
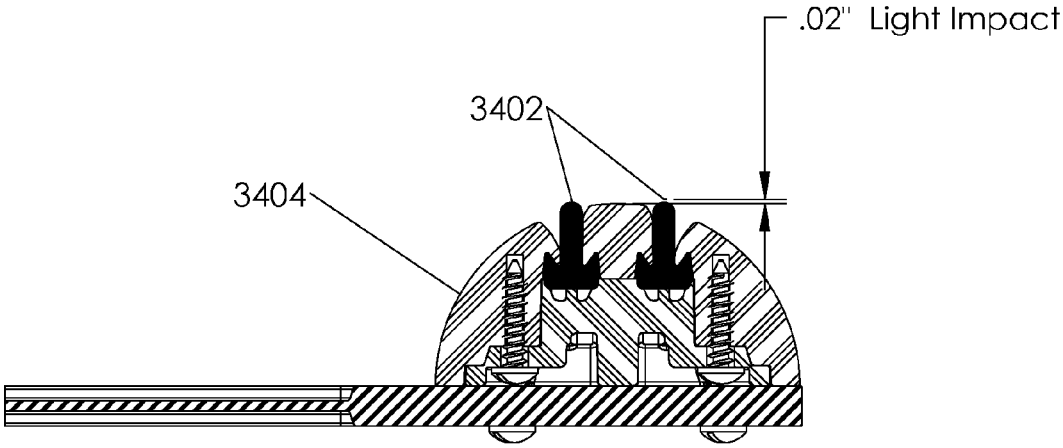
FIGS. 35 and 36 illustrate how the inertia of the print strips allows them to pop out or extend beyond the surface of the spherical surface of the practice target or cartridge when struck by a golf club head.
Figure 36:
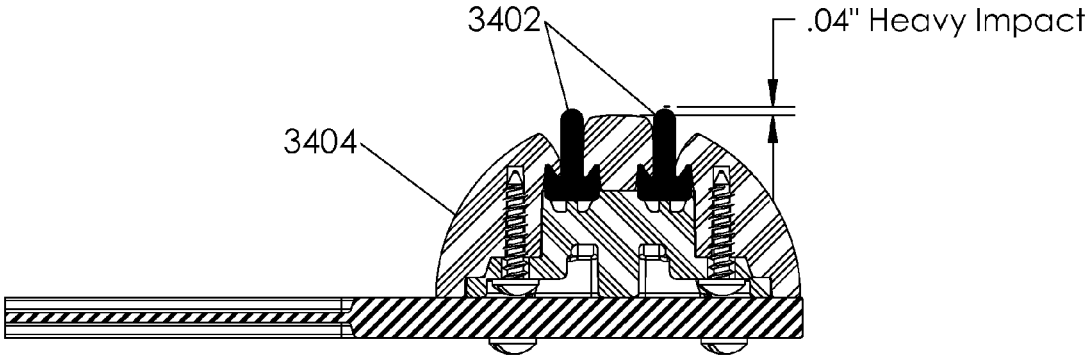

FIGS. 34, 35, and 36 illustrate various exemplary states of the print strips in a one embodiment of a practice target. FIG. 34 illustrates how the print strips 3402 are submerged below the outer surface (e.g., 0.024 inches) of the practice target 3404 before impact. That is, the print strips 3402 are positioned near the surface of the practice target 3404. The amount by which the print strips 3402 are submerged depends on various factors including the shape of the practice target, the compression of the practice target, flexing of the print strips 3402, among other design factors.

FIGS. 35 and 36 illustrate how the inertia of the print strips 3402 allows them to pop out or extend beyond the spherical surface of the practice target 3404 when the practice target 3404 is struck by a golf club. Because the print strips 3402 extend out more or less depending on the force with which the practice target 3404 is struck, the marks made on the golf club head provide an indication the relative speed of the club head during impact. That is, a different mark footprint (width and/or length) is made by the print strips 3402 on the golf club head depending on the speed and angle of the golf club face. For example, when a golf club face is angled in a close face (hook) or open face (slice) orientation relative to the practice target 3402 during impact, the separation of the print strips 3402 assures that the lengths of the print marks will be different because one print strip or the other will be closer to the direct tangent point of impact on the golf club face. When the club face impacts the practice target 3404 with a square hit, both print marks made by print strips 3402 will be approximately of equal length. The present invention has been described above as including a marker which prints or otherwise deposits a small nonpermanent mark on the face of the golf club corresponding to the impact location of a golf ball simulated by the target during the practice swing. An alternative embodiment of the invention, instead of depositing a mark on the face, deposits an impact mark either on an impact sticker on the face of the golf club head or on a spray coating on the face. The stickers are known in the art as shown by U.S. Pat. No. 5,142,309 (Lee) and by many commercially available "impact marking decals," such as the CADDYPATCH Suede Leather Ball Impact Marker and the LONGSHOT Impact Labels; and the spray can be the On-Mark Impact spray "Game Improvement in a Can."

In yet another implementation, instead of the marker depositing a print spot on the face of the golf club head, a further embodiment of the invention makes a scuff mark. To make the scuff mark, the marker would not include marking fluid. Rather, the marker would be formed of a material such as hard rubber which leaves a scuff mark when it impacts a golf club head face.

Figure 37:
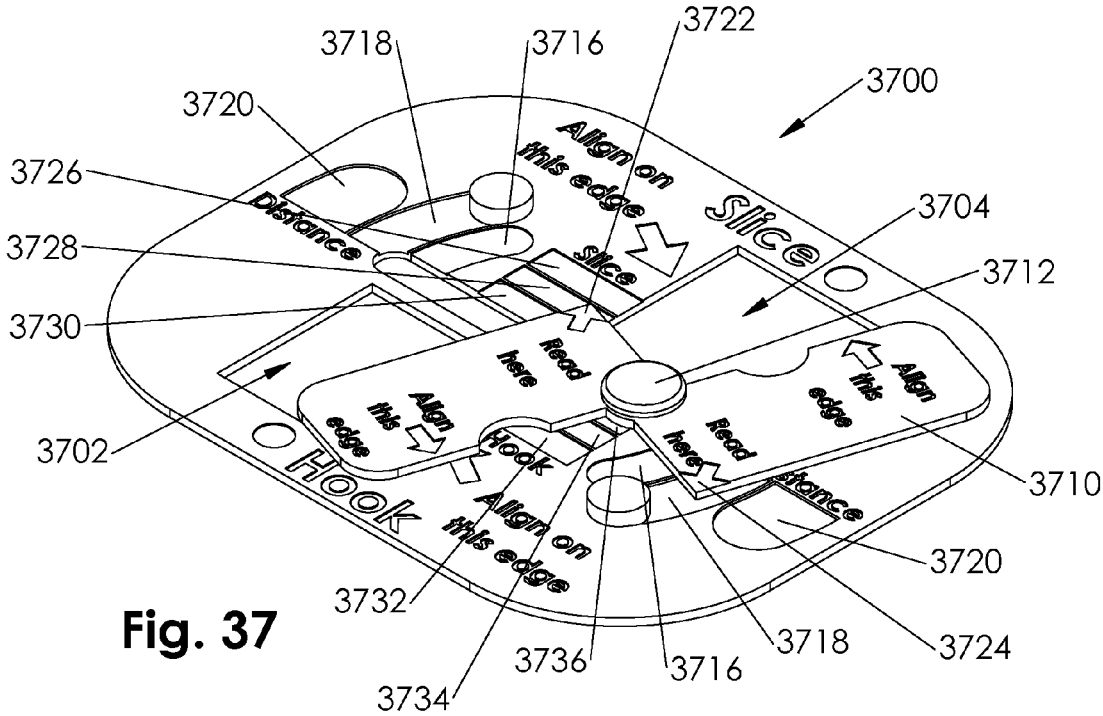
FIGS. 37 and 38 illustrate a reader card that may be used in conjunction with the golf swing practice apparatus to determine what one or more marks indicate about the quality of the practice swing.
Figure 38:
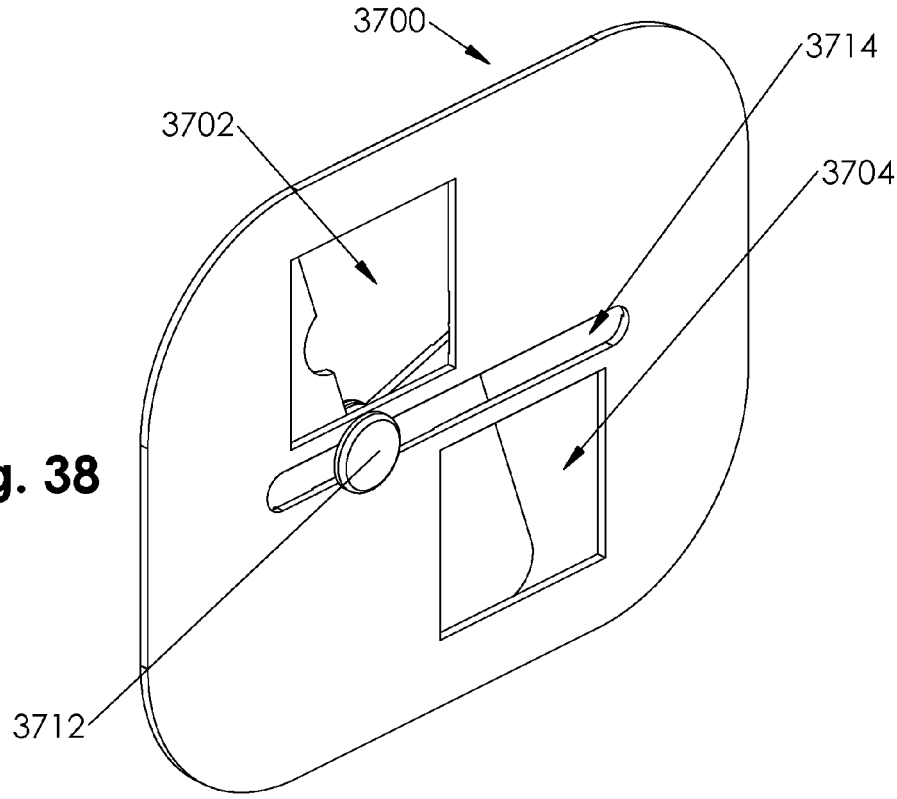

FIGS. 37 and 38 illustrate a reader card that may be used in conjunction with the golf swing practice apparatus to determine what a mark indicates. For example, the amount of the hooking or slicing action can be measured with this novel tool. FIG. 37 illustrates a front view of this reader card 3700 while FIG. 38 illustrates a back view. A "windmill-shaped member" 3710 is pivotally coupled at its center location by a pin or rivet 3712 to the card 3700 of the device and the pin or rivet can slide in the slot 3714 in the reader card 3700 for adjustment and reading purposes. The card 3700 has two windows 3702 and 3704.

The reader card 3700 is oriented and positioned for either hook or slice conditions. The windmill 3710 is slid via its pin or rivet 3712 in the slot 3714 and rotated to align it. The card is then read, by noting which of the bands—the first 3716 (which indicates a light hit—a tap), the second 3718 (which indicates a medium hit) and the third 3720 (which indicates a hard hit). The bands 3716, 3718, and 3720 can be differently colored, and more than three bands can be provided or even just two. The position of the windmill 3710 also indicates the amount of hook or slice. For example, the location of the slice arrow 3722 relative to bands 3726, 3728, and 3730 indicate the amount of slice. Similarly, the location of hook arrow 3724 relative to bands 3732, 3734, and 3736 indicates the amount of hook.

Figure 39:
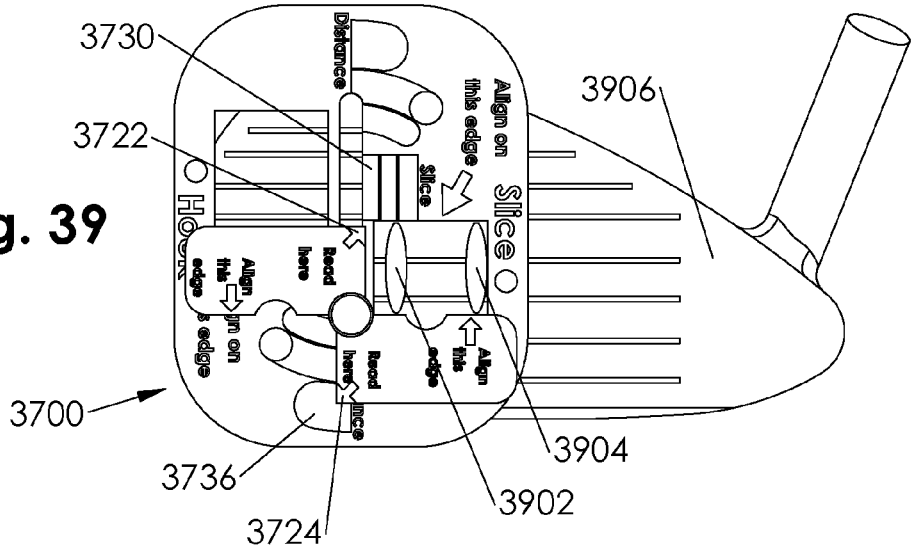
FIGS. 39, 40, and 41 illustrate how two marks may be read using the reader card.
Figure 40:
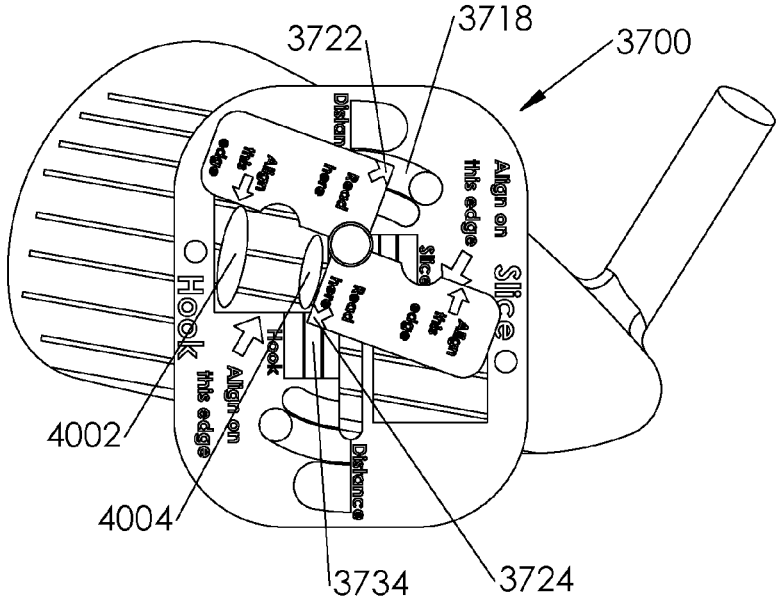
Figure 41:
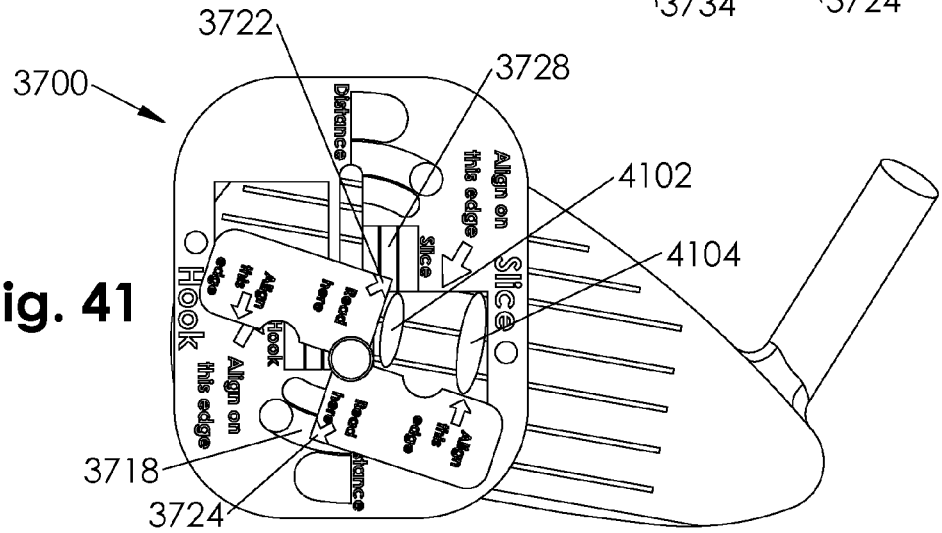

FIGS. 39, 40, and 41 illustrate how two marks may be read using the reader card 3700. To determine whether a particular set of marks indicate a square (straight), open face (hook), or close face (slice) impact, the marks are aligned against a first edge of the reader cared opening 3702 or 3704 while the opposite ends of the marks are aligned against an edge of the windmill 3710. At this moment, the arrows 3722 and 3724 would indicate the distance and amount of hook or slice.

FIG. 39 illustrates two equal-length marks 3902 and 3904 on the face of a golf club head 3906. In this example, arrow 3722 indicates that the two marks 3902 and 3904 are straight (i.e., a square impact, no slice or hook) by pointing to the no slice (square) band 3730. Meanwhile, arrow 3724 indicates that this was a relatively long distance 3736. FIG. 40 illustrates an exterior long mark 4002 and an interior short mark 4004, indicating a hook where the distance is indicated by arrow 3722 pointing to distance 3718 and the amount of hook is indicated by arrow 3724 pointing to band 3734. FIG. 41 illustrates an exterior short mark 4102 and an interior long mark 4104, indicating a slice where the distance is indicated by arrow 3724 pointing to distance 3718 and the amount of slice is indicated by arrow 3722 pointing to band 3728.

Yet another aspect of the invention provides a software application or website that a user can access to learn more about his/her swing based on the markings on the golf club face. The software application or website may provide animated instruction on how to correct different swing problems based on the markings on the club face.

Another aspect of the invention may provide additional features built into the golf swing practice system. Various sensors may be mounted on the target or the apparatus that measure velocity, force, and/or acceleration. For instance, a force sensor on the target may indicate the force with which the target is struck and display it on a display screen on the apparatus. Additionally, the measured force may be converted to an equivalent distance that a golf ball would have traveled. This equivalent distance may be provided to the golfer via said display. Alternatively, velocity or acceleration sensors may be mounted at or near the apparatus that indicates the velocity and/or acceleration of the golf club head before it strikes the target or the velocity and/or acceleration of the target after being struck by the golf club head. Such velocity and/or acceleration information may then be converted into an equivalent distance that a golf ball would have traveled and is provided to the golfer. Such sensors may be controlled by a small processor coupled to the apparatus. Additionally, a communication port may be provided as part of the apparatus that permits coupling the apparatus to a computer to record or download information from the apparatus and/or its sensors.

From the foregoing detailed description, it will be evident that there are a number of changes, adaptations and modifications of the present invention which come within the province of those skilled in the art. The scope of the invention includes any combination of the elements from the different species or embodiments disclosed herein, as well as subassemblies, assemblies, and methods thereof. As examples only, the various target and ground or mat anchors can be interchanged as can the print, scuff or impact arrangements, as well as the materials and dimensions. All such variations not departing from the spirit of the invention are considered as within the scope thereof.

It should be noted that the foregoing embodiments are merely examples and are not to be construed as limiting the invention. The description of the embodiments is intended to be illustrative, and not to limit the scope of the claims.

What is claimed is:

1. A golf swing practice apparatus, comprising:

a golf ball simulation target;

a supporting member for supporting the target, the support member adapted to anchor the target;

the target being movable relative to the supporting member between a normal configuration and an impacted configuration when impacted by a golf club head during a golf practice swing; and a marker coupled to the target and adapted to mark the face of the golf club head when the face impacts the target during the golf practice swing.

2. The apparatus of claim 1 further comprising a connector arm connecting the target to the supporting member.

3. The apparatus of claim 2 wherein the connector arm offsets a central line of the target a horizontal distance from the supporting member.

4. The apparatus of claim 2 wherein the arm is configured to be raised or lowered relative to the supporting member to adjust the height of the target relative to a practice surface.

5. The apparatus of claim 1 wherein the supporting member includes a stake that can be manually pushed into the ground.

6. The apparatus of claim 1 wherein the supporting member includes a base adapter plate to couple the supporting member to a golf practice mat.

7. The apparatus of claim 1 wherein the marker is a print marker that includes a body containing marking liquid or marking gel.

8. The apparatus of claim 1 wherein the marker includes one or more print strips that, when the target is impacted by a golf club head, makes one or more marks on the golf club head.

9. The apparatus of claim 8 wherein the one or more marks indicate the orientation of the golf club head relative to the target.

10. The apparatus of claim 8 wherein the one or more marks indicate the relative force with which the target is struck.

11. The apparatus of claim 1 wherein the target is adapted to resiliently spring back after it is impacted by a golf club during the practice swing.

12. The apparatus of claim 1 wherein the target has a substantially spherical shape approximately the size of a golf ball.

13. The apparatus of claim 1 wherein the target has a substantially semi-spherical shape approximately the size of half a golf ball.

14. A golf swing training practice apparatus, comprising:

a golf ball simulation target;

support means for supporting the target to a support surface; and marking means for marking a face of a golf club head with at least one mark as the face impacts the target during a golf practice swing on the target.

15. The apparatus of claim 14 wherein the marking means includes a print member.

16. The apparatus of claim 14 wherein the marking made by the marking means on the face of the golf club head indicates the position of impact of the golf ball simulation target and the golf club head.

17. The apparatus of claim 14 wherein the support surface is a golf training mat.

18. The apparatus of claim 14 wherein the marking means includes a print marker having a marking surface and a holder adapted to secure the print marker to the target.

19. The apparatus of claim 14 wherein the marking means includes a marking body and marking liquid held in the body by wicking or capillary action.

20. The apparatus of claim 14 wherein the marking made by the marking means on the face of the golf club head provides a relative indication of the force of impact of the golf club head by the size of the marking.

21. The apparatus of claim 14 wherein the marking made by the marking means on the face of the golf club head provides an indication of swing characteristics at the moment in which the golf ball simulation target is struck by the golf club head.

22. The apparatus of claim 14 wherein the marking means is positionable in a first orientation with respect to the support means for right-handed golfers and in an alternative second orientation with respect to the support means for left-handed golfers.

23. A golf swing practice apparatus, comprising:

a vertically adjustable post assembly;

a target assembly including a golf ball simulation target and an arm for attaching the golf ball simulation target to the post assembly at selectively different heights on the post assembly and spaced horizontally from the post assembly; and a print media attachable to the target for marking a golf club face during a practice swing on the target.

24. The apparatus of claim 23 wherein the post assembly includes securing means for securing the post assembly alternatively to a ground stake and to a training mat anchor.

25. The apparatus of claim 23 wherein the golf ball simulation target is attachable to the arm in a right-handed golfer position and in an alternative left-handed golfer position.

26. The apparatus of claim 23 further comprising a ground stake and a golf training mat anchor assembly, both alternatively attachable to the target assembly.

27. The apparatus of claim 23 further comprising a locking pin for releasably securing the arm to the post assembly at the selectively different heights.

28. A golf swing practice apparatus, comprising:

a golf ball simulation target attachable in a golf swing practice position to a support member;

a first marker connected to the target to mark a golf club head with a first mark during a golf practice swing on the target; and a second marker connected to the target to mark the golf club head with a second mark during the golf practice swing.

29. The apparatus of claim 28 wherein the first and second marks are substantially parallel to one another.

30. The apparatus of claim 28 wherein the first and second marks can be used to determine whether the golf practice swing was a square, open, or close faced swing at impact of the golf ball simulation target to the golf club head.

31. The apparatus of claim 28 wherein the first and second marks indicate the proximate position where the golf club head would have contacted a real golf ball.

32. The apparatus of claim 28 wherein when the first mark is longer than the second mark, a closed face impact of the golf club head is indicated, and when the first mark is shorter than the second mark, an open face impact of the golf club head is indicated.

33. The apparatus of claim 28 wherein different lengths of the first and second marks indicate an open or close face impact by the golf club head and equal lengths of the marks indicate a square hit by the golf club head.

34. The apparatus of claim 28 wherein the first and second markers are print strips formed as part of a replaceable cartridge.

35. The apparatus of claim 28 wherein the average lengths of the first and second marks indicate the relative speed of the golf club head at impact with the golf ball simulation target.

36. A golf swing practice target, comprising:

a target assembly having a semispherical face and configured to withstand a golf swing impact; and a marking body held by the target assembly, the marking body adapted to leave a mark on a golf club when the target assembly is struck by the golf club.

37. The golf swing practice target of claim 36 wherein the marking body is positioned below an outer surface of the target assembly and extends beyond the outer surface when the target assembly is struck by a golf club.

38. The golf swing practice target of claim 36 wherein the target assembly has a spherical shape approximately the size of a golf ball.

39. The golf swing practice target of claim 36 wherein the target assembly includes at least two parallel marking bodies that permit diagnosis of a golf club practice swing.

* * * * *